US008442676B2

(12) United States Patent
Kobayashi et al.

(10) Patent No.: US 8,442,676 B2
(45) Date of Patent: May 14, 2013

(54) MEDICATION STORAGE

(75) Inventors: Koichi Kobayashi, Ashikaga (JP); Manabu Haraguchi, Gunma-ken (JP); Akinori Hatsuno, Gunma-ken (JP)

(73) Assignee: Panasonic Healthcare Co., Ltd., Toon-shi (JP)

( * ) Notice: Subject to any disclaimer, the term of this patent is extended or adjusted under 35 U.S.C. 154(b) by 737 days.

(21) Appl. No.: 12/076,803

(22) Filed: Mar. 24, 2008

(65) Prior Publication Data

US 2009/0236954 A1 Sep. 24, 2009

(51) Int. Cl.
*G06F 17/00* (2006.01)

(52) U.S. Cl.
USPC ..... 700/242; 221/119; 221/120; 221/121

(58) Field of Classification Search ..... 221/119, 221/120, 121; 700/242
See application file for complete search history.

(56) References Cited

U.S. PATENT DOCUMENTS

| | | | | |
|---|---|---|---|---|
| 4,846,367 | A * | 7/1989 | Guigan et al. | 221/121 |
| 5,239,491 | A * | 8/1993 | Mucciacciaro | 702/177 |
| 5,337,920 | A * | 8/1994 | Clausen | 221/121 |
| 6,874,684 | B1 | 4/2005 | Denenberg et al. | |
| 7,040,504 | B2 * | 5/2006 | Broadfield et al. | 700/236 |
| 7,086,198 | B2 * | 8/2006 | Hayden | 221/120 |
| 7,086,558 | B1 * | 8/2006 | Pixley et al. | 221/7 |
| 7,395,945 | B2 * | 7/2008 | Godlewski | 221/122 |
| 7,463,947 | B1 * | 12/2008 | Frederick et al. | 700/236 |
| 7,588,165 | B2 * | 9/2009 | Prichard et al. | 221/122 |
| 7,676,299 | B2 * | 3/2010 | Clarke et al. | 700/231 |
| 7,805,216 | B2 * | 9/2010 | Shows et al. | 700/231 |
| 2008/0029601 | A1 | 2/2008 | Clarke et al. | |

FOREIGN PATENT DOCUMENTS

| | | |
|---|---|---|
| JP | 05-147706 | 6/1993 |
| JP | 7-24044 | 1/1995 |
| JP | 09-172863 | 7/1997 |
| JP | 2000-102594 | 4/2000 |
| JP | 2000-167024 | 6/2000 |
| JP | 2002-017821 | 1/2002 |
| JP | 2002-345928 | 12/2002 |

OTHER PUBLICATIONS

Japanese Office Action issued in counterpart application No. 2006-303094 on Sep. 6, 2011 (3 pages).

* cited by examiner

*Primary Examiner* — Timothy Waggoner
(74) *Attorney, Agent, or Firm* — Kratz, Quintos & Hanson, LLP

(57) ABSTRACT

A medication storage for storing medications while cooling down them is constituted so as to allow a medication based on prescription data to be certainly taken out. The medication storage cools down inside a storeroom for storing the medications to a predetermined temperature by a cooling unit. The medication storage, includes: a plurality of shelves rotatably provided in the storeroom; a plurality of storage partitions which are respectively constituted on each shelf and store the medications; a motor for rotating the shelves; a plurality of openings provided respectively for being arranged to correspond to each of the shelves thereby allowing only medication in any one of the storage partitions to be taken out; a plurality of doors for openably closing each opening, respectively; a plurality of lock solenoids for locking each door, respectively; and a control unit for controlling the motor and the lock solenoid. The controller permits the shelves to be rotated based on the prescription data so as to bring a predetermined storage partition to a position corresponding to the opening and then to permit the lock solenoid to be unlocked.

7 Claims, 12 Drawing Sheets

MEDICATION STORAGE

BACKGROUND OF THE INVENTION

1. Field of the Invention

The present invention relates to a medication storage for storing medications, such as blood, reagents, or the like, while cooling them.

2. Description of the Related Art

Conventionally, when storing medications such as blood, drugs, or the like which need to be refrigerated, a storage for storing the medications while cooling down to a temperature (for example, approximately +4° C.) suitable for the preservation is used (for example, refer to Japanese Laid-open (Kokai) Patent Publication No. 2000-102594). In such a medication storage, the temperature has been strictly managed compared with household refrigerators or the like in order to prevent the freeze or degradation of the medications, and it has also been required to be locked in order to prohibit the medications from being incorrectly prescribed or being carried out without authorization, and to be unlocked in taking out the medications therefrom.

Nevertheless, the conventional medication storage has adopted such a manner that medications are stored side-by-side on shelves and a worker or handler has selected and taken out medications on the shelves based on a prescription after the storage has been unlocked, and thus there has been a risk that the worker might erroneously take out incorrect medications from the medication storage. In order to prevent such an error, there are some medication storages in which shelves are preliminarily sectioned into plural partitions and each partition where a prescribed medication is stored may be provided with respective indications, but there are disadvantages also in this case that such problems could not be solved when the indication has been misidentified or when a medication in a partition different from the indicated partition has been intentionally taken out (for example, refer to Japanese Laid-open (Kokai) Patent Publication No. 7-24044).

Therefore, the present invention is made to solve such technical problems as encountered by the conventional art of the medication storage, and has its object to allow medications based on prescription data to be certainly taken out of a medication storage for storing medications while cooling down them.

SUMMARY OF THE INVENTION

A medication storage according to a first aspect of the present invention is configured to cool down inside a storeroom for storing medications to a predetermined temperature by a cooling unit, and comprises:

a plurality of shelves rotatably provided in the storeroom;

a plurality of storage partitions provided for each of the respective shelves for storing the medications, respectively;

a driving means for rotating the shelves;

a plurality of openings provided respectively to correspond to each of the respective shelves for allowing only medication in any one of the storage partitions to be taken out therethrough;

a plurality of doors for openably closing each of the openings, respectively;

a plurality of locking means for locking each of the doors, respectively; and a control means for controlling the driving means and the locking means, wherein the control means is configured to permit the drive means to rotate the shelves based on prescription data thereby allowing a predetermined storage partition of the storage partitions corresponding to one of the openings and then to permit the locking means of the door which closes the opening to be unlocked.

The medication storage according to a second aspect of the present invention is further provided with such a configuration that a plurality of storage containers is provided to be removably attached to each of the above-mentioned shelves, respectively, each of the storage containers defining therein each of the storage partitions and being capable of being taken out through the opening.

The medication storage according to a third aspect of the present invention is further provided with such a configuration that display means is provided, and the above-mentioned control means permits the display means to display a number of medications to be taken out based on prescription data.

The medication storage according to a fourth aspect of the present invention is further provided with such a configuration that a plurality of the above-mentioned display means are provided for being arranged to correspond to each of the doors, respectively.

The medication storage according to a fifth aspect of the present invention is further provided with such a configuration that there is provided a plurality of the above-mentioned driving means to be arranged to correspond to each of the shelves, respectively.

The medication storage according to a sixth aspect of the present invention is further provided with such a configuration that the driving means is provided in the storeroom, rotation preventing means is provided in the storeroom, which is configured to allow the shelves rotating upon being electrically turned on while prohibiting the shelves rotating upon being electrically turned off, and the control means electrically turns off the driving means and the rotation preventing means in a state where the above-mentioned shelves are to be not rotated.

The medication storage according to a seventh aspect of the present invention is further provided with such a configuration that the control means permits the drive means to rotate the shelves in a standby state.

In accordance with the first aspect of the present invention, a medication storage is configured to cool down inside a storeroom for storing medications to a predetermined temperature by a cooling unit, and comprises:

a plurality of shelves rotatably provided in the storeroom;

a plurality of storage partitions provided for each of the respective shelves for storing the medications, respectively;

a driving means for rotating the shelves;

a plurality of openings provided respectively to correspond to each of the respective shelves for allowing only medication in any one of the storage partitions to be taken out therethrough;

a plurality of doors for openably closing each of the openings, respectively;

a plurality of locking means for locking each of the doors, respectively; and a control means for controlling the driving means and the locking means, wherein the control means configured to permit the drive means to rotate the shelves based on prescription data thereby allowing a predetermined storage partition of the storage partitions corresponding to one of the openings and then to permit the locking means of the door which closes the opening to be unlocked. Therefore, degradation of drug efficacy can be prevented by storing medications while cooling them in the storeroom, and when a prescribed medication according to the prescription thereof is taken out of the storeroom, the control means automatically rotates the shelves based on the prescription data to permit the storage partition in which the prescribed medication is stored to be brought to a state where the storage partition corresponds to one of the openings, and then to permit the locking means of the door of the above-mentioned opening to be unlocked. This makes it possible for the worker or handler to take out the prescribed medication through the opening whose door is unlocked.

Since only medications in the storage partition can be taken out through the opening at this time, the disadvantages that the medications other than the prescribed medication may be taken out of the storeroom can be certainly prevented. This makes it possible to prevent so-called accidental ingestion or theft of the medications from occurring. In particular, upon intendedly taking out one of the medications from the medication storage, only the opening of the shelf in which the medication is stored may be opened, cold air leakage from the storeroom can also be reduced in the minimum level. This makes it possible to highly maintain cooling performance in the storeroom as well.

Moreover, in addition to the above-mentioned configuration, in accordance with the second aspect of the present invention, each storage partition is formed in each of the plurality of storage containers that are removably attached to each of the shelves, respectively, and the storage container may be taken out through one of the openings, so that for example, when the storage partition is replenished with medications, the work for replenishment can be performed while the storage container is taken out through the opening, resulting in a significant improvement in workability.

Moreover, in accordance with the third aspect of the present invention, the display means is further provided in addition to each of the afore-mentioned aspects of the present invention and the control means allows the display means displaying the number of the medications to be taken out based on the prescription data, so that for example, when a person other than that who has prescribed takes out the medications, disadvantages that the medications with an incorrect number might be taken out can be avoided from occurring. In this case, if a plurality of the above-mentioned display means is provided so that each of the respective display means corresponds to each door, as described in claim 4, each medication can be taken out without mistaking the number even when the medications are taken out from the plurality of shelves.

Moreover, in accordance with the fifth invention, since the plurality of driving means are provided corresponding to each of the respective shelves, respectively, in addition to each of the afore-mentioned aspects of the present invention, the plurality of shelves may be independently rotated simultaneously, thus allowing a significant improvement in working efficiency.

Moreover, in accordance with the sixth aspect of the present invention, since the driving means are provided in the storeroom and rotation preventing means for allowing a rotation of the shelves when electrically turned on, and prohibiting the rotation of the shelves when electrically turned off is also provided in the storeroom in addition to each of the aforementioned aspects of the present invention, and the control means permits the driving means and the rotation preventing means to be turned off in a state where the shelves are to be not rotated, a standby state or a halting state where the predetermined storage partition of the shelf is brought to a condition corresponding to the opening may be certainly maintained, and the driving means and the rotation preventing means are not electrically turned on in such halting state, thus also reducing adverse effects on cooling performance in the storeroom by the heat generating from these means to the minimum level. Moreover, since the disadvantage that the shelves are freely rotated can also be prevented by the rotation preventing means, the disadvantage that the medications other than the prescribed medication are taken out of the storeroom can be more certainly prevented.

Further, as described in the seventh aspect of the present invention, when the control means is configured to permit the driving means to rotate the shelves in the standby state, the medications in each storage partition on each shelf can be uniformly cooled down, thus allowing a significant improvement in preserving performance of the medications.

DESCRIPTION OF THE PREFERRED EMBODIMENTS

Figure 1:
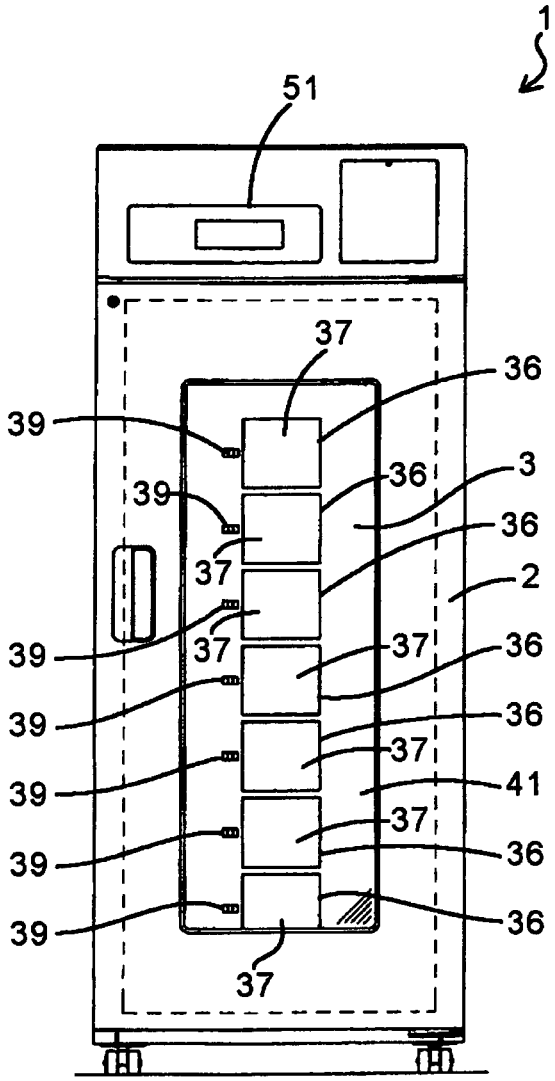
FIG. 1 is a front view of a medication storage according to one embodiment of the present invention.
Figure 2:
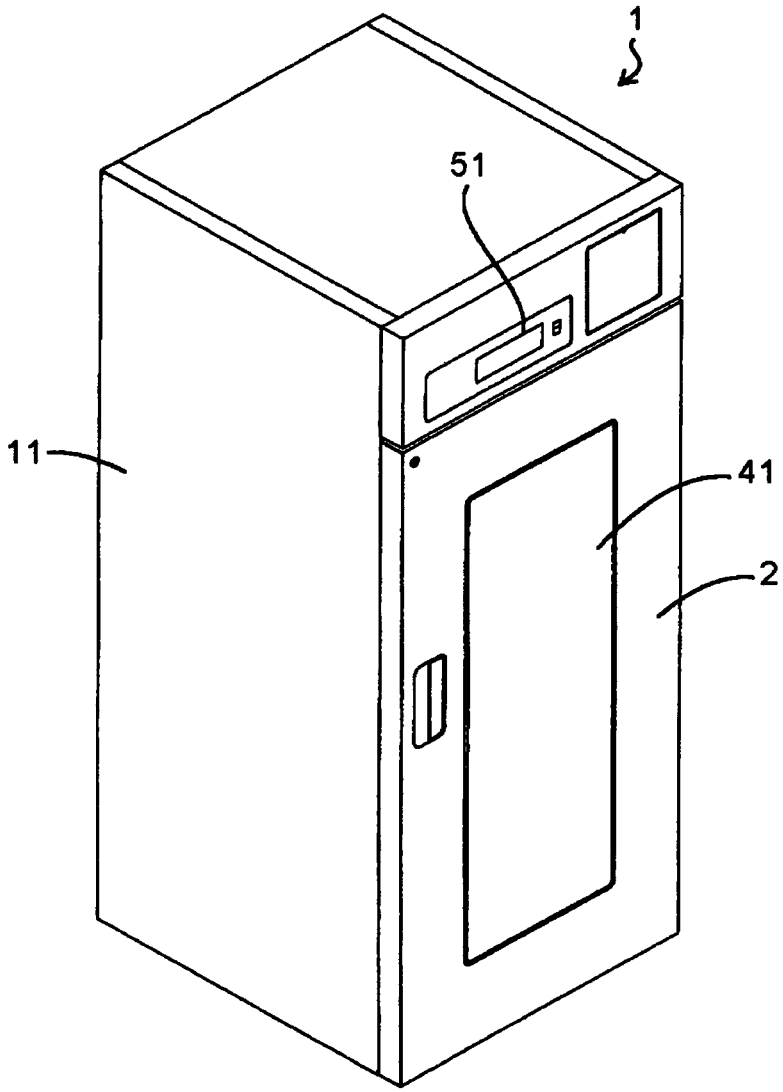
FIG. 2 is a perspective view of the medication storage in FIG. 1.
Figure 3:
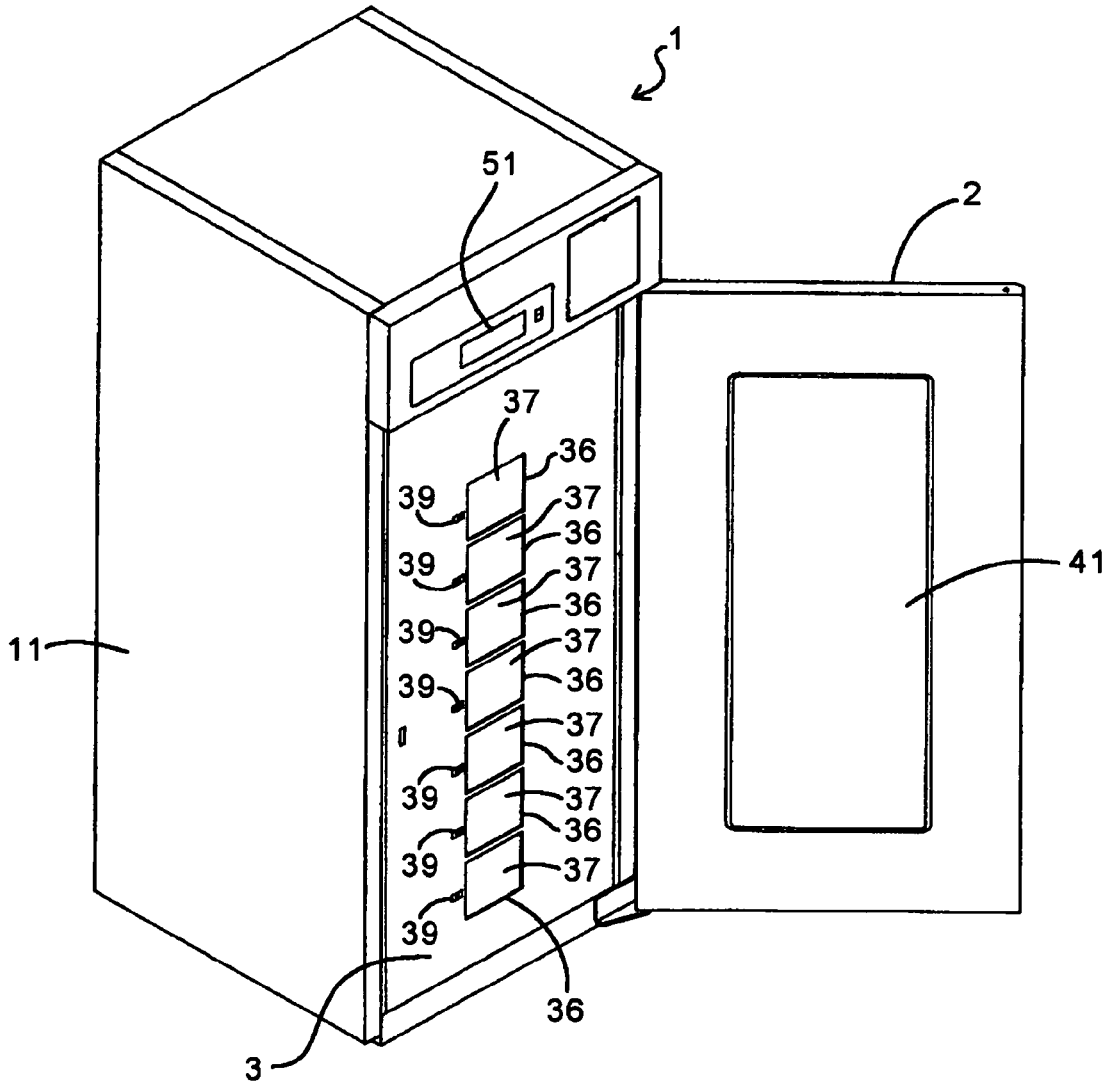
FIG. 3 is a perspective view of the medication storage in FIG. 1 in a state where an outer door is opened.
Figure 4:
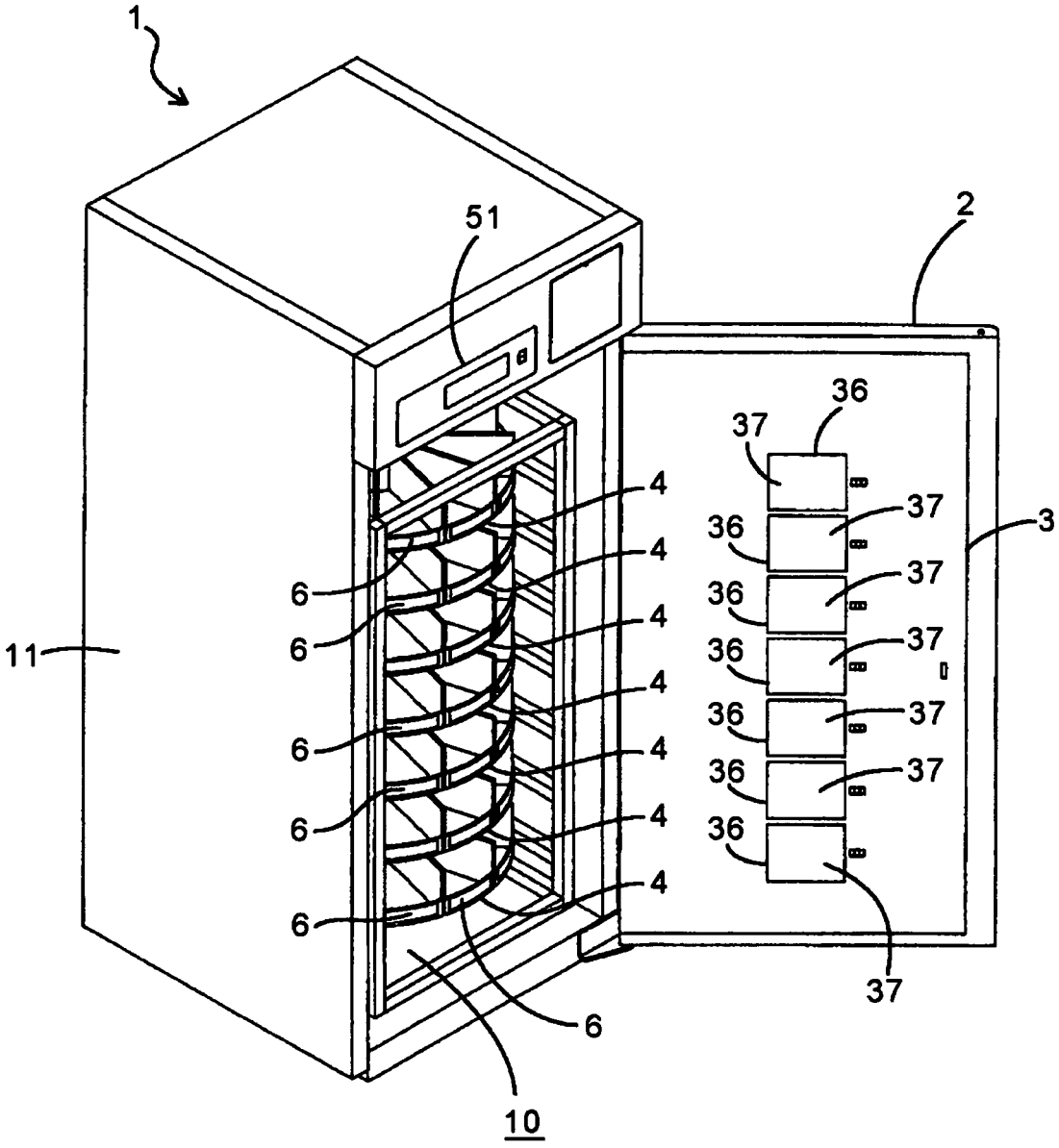
FIG. 4 is a perspective view of the medication storage in FIG. 1 in a state where the outer door and an inner door are opened.
Figure 5:
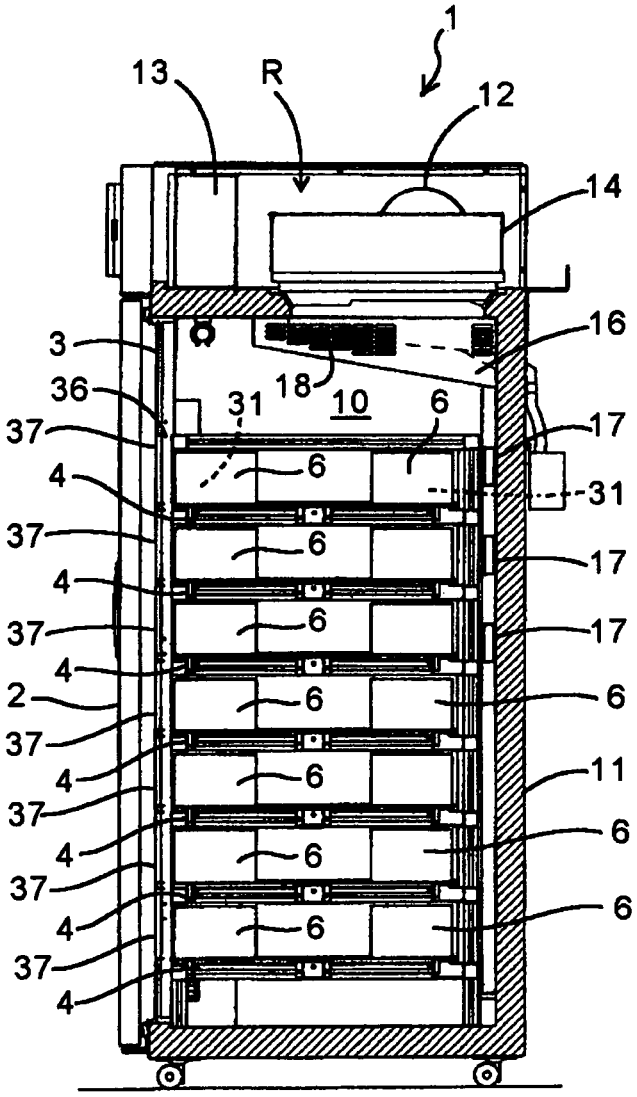
FIG. 5 is a longitudinal cross-sectional view of the medication storage in FIG. 1.
Figure 6:
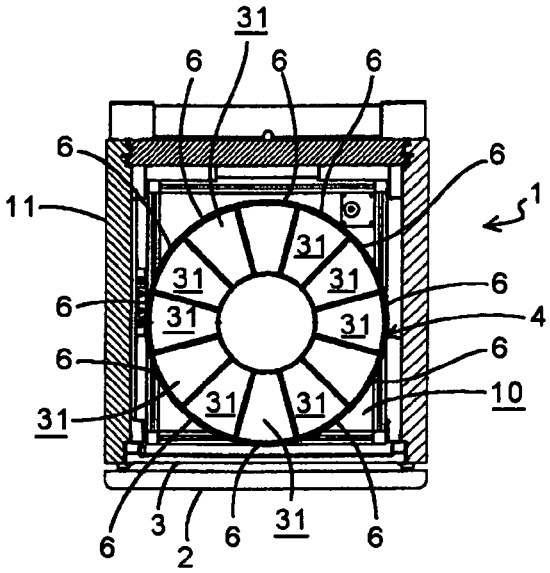
FIG. 6 is a plan and cross-sectional view of the medication storage in FIG. 1.
Figure 7:
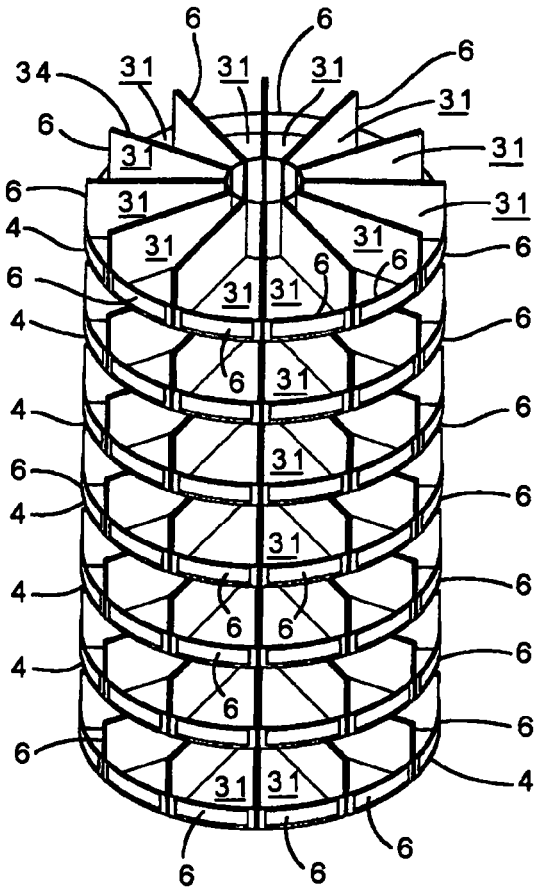
FIG. 7 is a perspective view of shelves to be incorporated in the medication storage in FIG. 1.

Hereinafter, preferred embodiments of the present invention will be described in detail with reference to the accompanying drawings.

A medication storage 1 is an apparatus for storing blood or medications which need to be refrigerated while cooling them, which is installed in hospitals, dispensing pharmacies, laboratories of universities or manufacturers, or the like, wherein a body 11 is constituted by a heat insulating housing whose front face is open. A storeroom 10 for storing medications is constituted inside the body 11, and a front face thereof is opened, and the opening is openably closed by a heat insulating outer door 2 and an inner door 3 thereinside. Note that, these outer door 2 and inner door 3 are usually locked, and the outer door 2 is unlocked to thereby be permitted to open and close during the work, while the inner door 3 is unlocked to thereby be permitted to open in performing maintenance inside the storeroom 10, or the like.

A compressor 12, a condenser 13, a cooling box 14, and the like which constitute a cooling unit R are arranged in a top face of the body 11, and a cooler and a fan, which are not shown, for constituting a known refrigerant circuit in the cooling unit R, along with the compressor 12 and the condenser 13 are housed in this cooling box 14. The inside of the cooling box 14 is then fluidly communicated with a duct 16 in the storeroom 10 of the body 11. The duct 16 is provided in an area extending from a ceiling to a back face in the storeroom 10 and a plurality of cold air outlets 17 are formed in a side face of a portion of the duct 16 located from a top to a bottom along the back face, and a cold air inlet 18 is formed in a portion of the duct 16 located on the ceiling.

A plurality of shelves 4 (seven shelves in the shown embodiment) are attached one above the other in the storeroom 10, and the cold air outlets 17 are formed corresponding to positions of height of the upper shelves 4. When the compressor 12 and the fan are then operated, the cooler exerts cooling action. Cold air having exchanged heat with this cooler is discharged into the duct 16 by the fan, and then passes through the duct 16 to be discharged into the storeroom 10 through the cold air outlets 17. The cold air which has circulated through the storeroom 10 and cooled down thereinside returns through the cold air inlet 18 to a suction side of the fan. As a result, the inside of the storeroom 10 is cooled down to an optimal predetermined temperature (approximately +4° C.) for storing medications.

Figure 8:
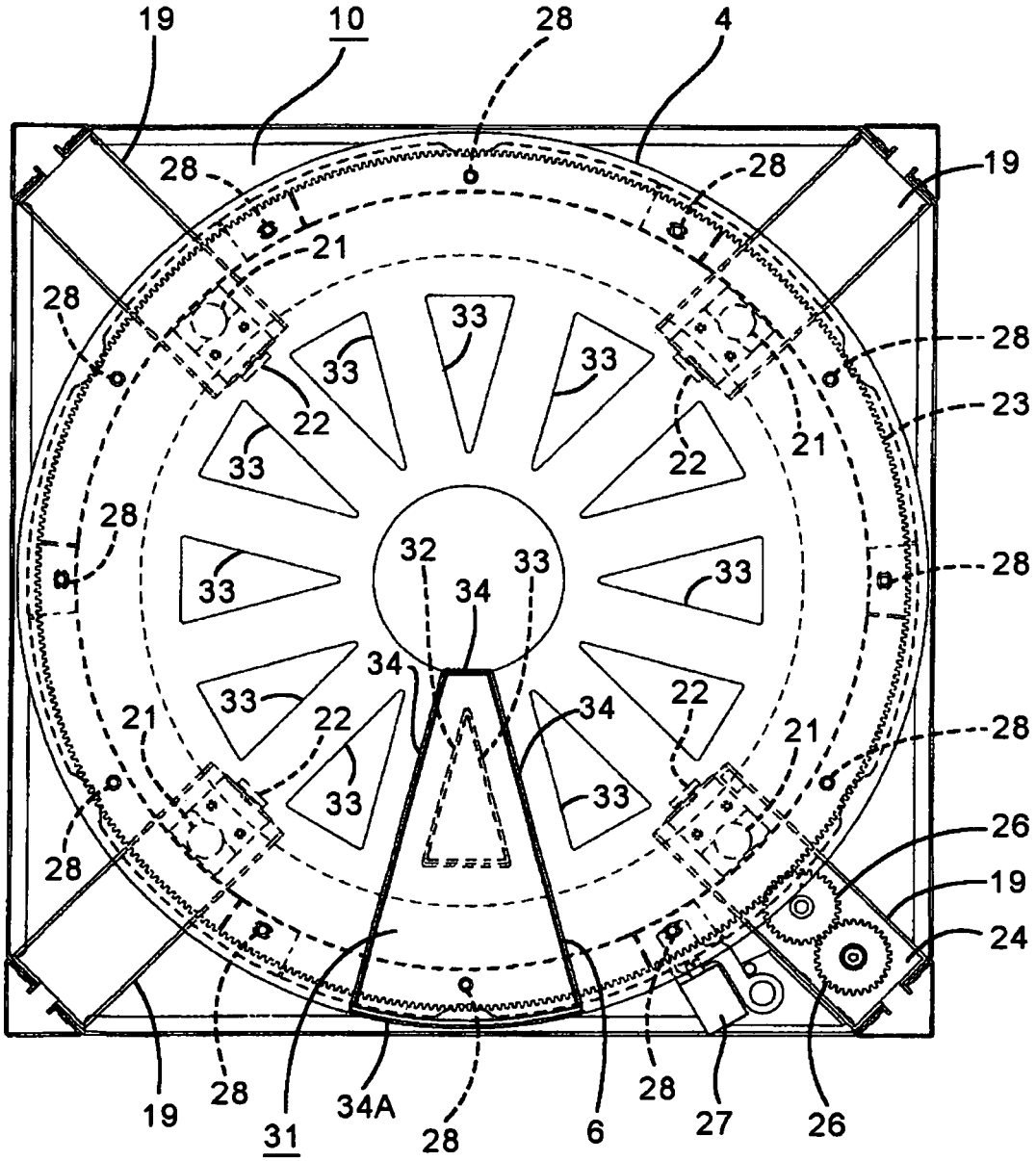
FIG. 8 is n enlarged plan view of the shelves in FIG. 7.
Figure 9:
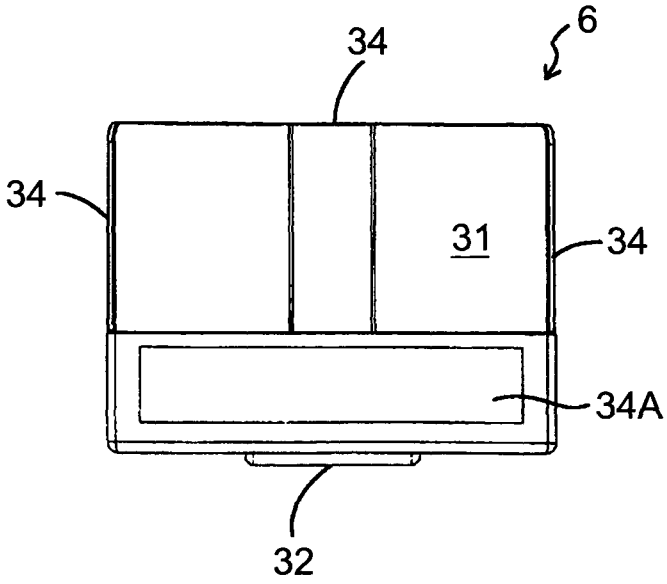
FIG. 9 is a front view of a storage container of the medication storage in FIG. 1.
Figure 10:
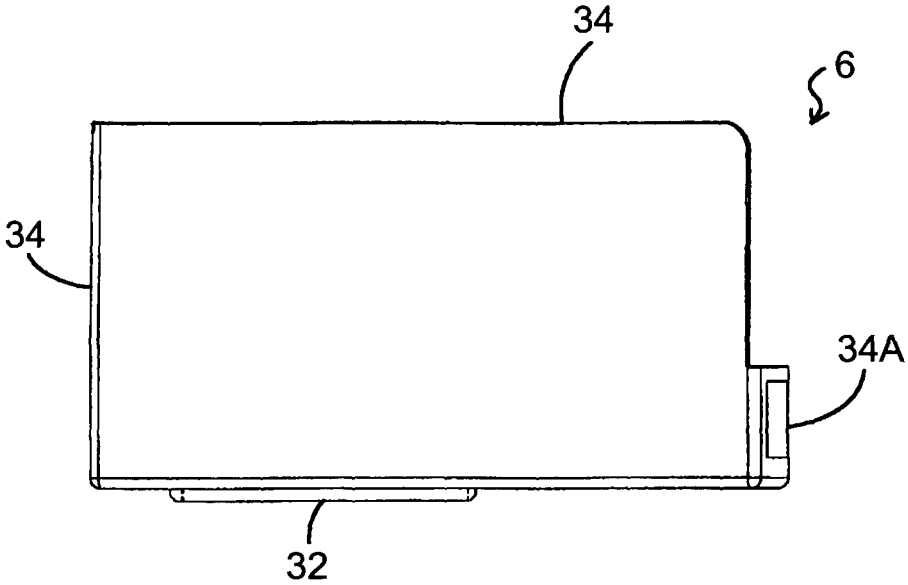
FIG. 10 is a side view of the storage container in FIG. 9.
Figure 11:
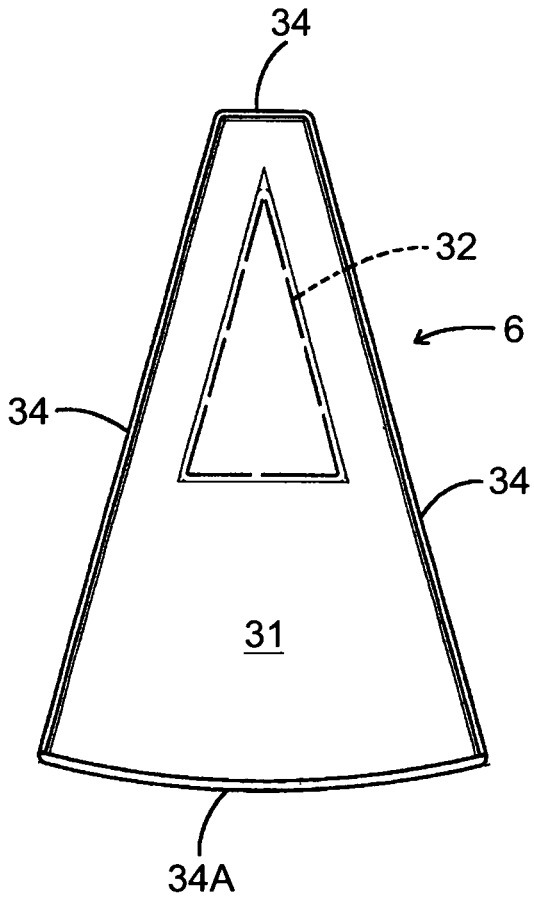
FIG. 11 is a plan view of the storage container in FIG. 9.
Figure 12:
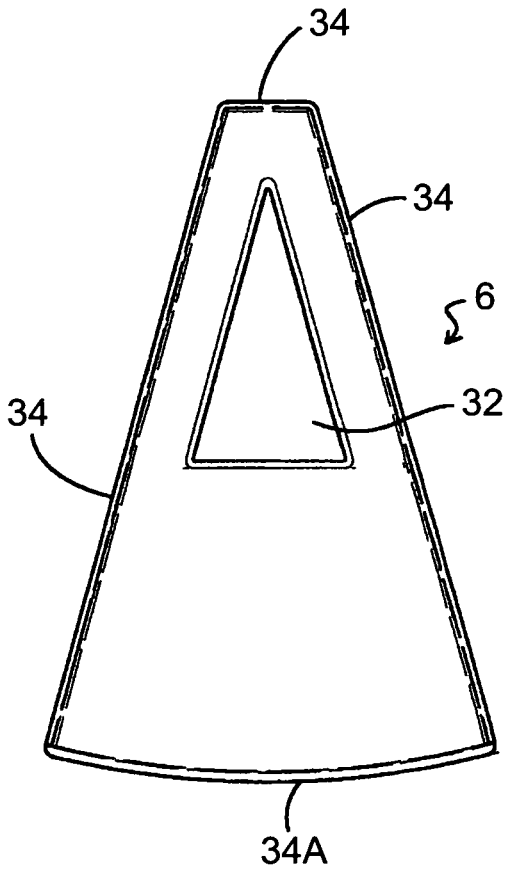
FIG. 12 is a bottom plan view of the storage container in FIG. 9.
Figure 13:
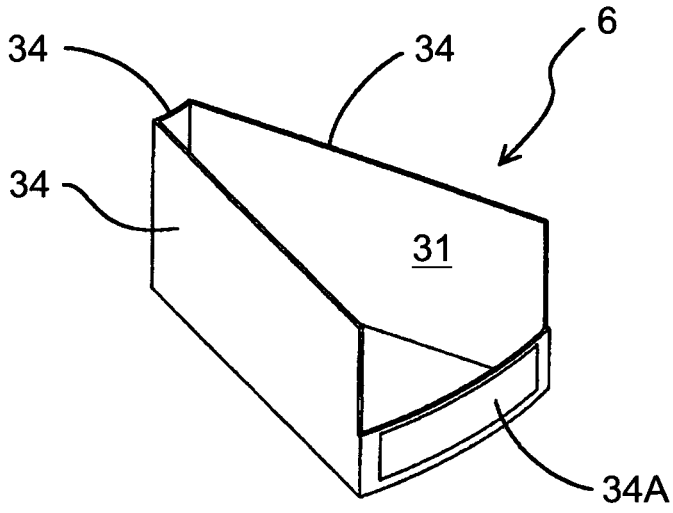
FIG. 13 is a perspective view of the storage container in FIG. 9.

Meanwhile, the shelves 4 are disc-shaped, each shelf 4 is independently and rotatably supported around a center of the storeroom 10, respectively by horizontal rollers 21 and vertical rollers 22 respectively attached to four frames 19 located in the four corners of the storeroom 10 (FIG. 8). In addition, a rack board 23 having gearing grooves formed in the circumference thereof is attached to a bottom face of each of the respective shelves 4, and reduction gears 26 of a plurality of motors (driving means) 24 attached to the frames 19 in the corners inside the storeroom 10 corresponding to each of the respective shelves 4 are engaged with the gear groove of each rack board 23, respectively. Each shelf 4 is independently rotated by these motors 24, respectively.

Furthermore, a plurality of solenoids (rotation preventing means) 27 are attached to the frames 19 so that each of the solenoids corresponds to each shelf 4 in the corners inside the storeroom 10, and each solenoid 27 is disengageably engaged with a plurality of (twelve pins in the embodiment) pins 28 arranged to protrude from the bottom face of the shelf 4 corresponding thereto. In this case, the solenoids 27 are disengaged from the pins 28 when it is electrically turned on for energization, and are engaged with the pins 28 when it is electrically turned off. Rotation of each of the respective shelves 4 is then independently prevented, in a state where the corresponding solenoid 27 is engaged with the pins 28.

Further, a plurality of (twelve containers in the embodiment) storage containers 6 are placed on each shelf 4 to be removably attached thereto, respectively, and the storage partitions 31 for storing the medications are constituted thereinside, respectively (only one partition is shown in FIG. 8 for the brevity sake). The storage container 6 is almost fan-shaped opened at an angle of 30 degrees (all circumference of the shelf 4 is partitioned into twelve) in the embodiment from the center of the shelf 4 when looked from a plan view, as shown in FIGS. 9 to 13, and twelve storage containers 6 are arranged on the shelf 4 almost without gaps therebetween, while setting a pivot of the fan as a center direction of the shelf 4. In such an arrangement, the storage containers 6 are arranged to form a circle as a whole, wherein a space inside the circle (space on the shelf 4) is partitioned into twelve by partitioning walls which radially extend from the center to thereby form the storage partitions 31. In this case, triangular engaging projecting parts 32 are formed in the bottom faces of the respective storage containers 6, and the engaging projecting parts 32 are removably engaged in twelve triangular engaging holes 33 formed in the shelf 4, so that each storage container 6 is unmovably positioned therein. Note herein that, in a rotation-prevented state where the solenoids 27 are engaged with the pins 28, the storage containers 6 (storage partitions 31) are arranged so that any one of them is located in a center of the front face of the storeroom 10 (FIG. 8).

The storage container 6 is a container which is provided with sidewalls 34 (respective sidewalls 34 and 34 of adjacent two storage containers 6 and 6 constitute the aforementioned partitioning walls) set up in the circumference, and whose top is opened, wherein only a sidewall 34A which is provided at an outer circumference side of the shelf 4 is constituted to be lower in its height, and the inside of the storage partition 31 is accessible only from this sidewall 34A side in a horizontally direction in a state where the container is attached on the shelf 4.

Meanwhile, seven openings 36 are formed one above the other in the center of the inner door 3. The storage container 6 (storage partition 31) located in the center of the front face corresponds to the backside of the opening 36 in the state where the solenoids 27 are engaged with the pins 28. Each opening 36 is a rectangular shape and small enough to allow fingers and only one storage container 6 to be taken out and stored. At this time, then storage partitions 31 of the storage containers 6 other than the storage containers 6 corresponding to the respective openings 36 cannot be accessed since the sidewalls 34 are formed in the circumferences of the storage containers 6. Namely, only the insides of the storage partitions 31 of the storage containers 6 can be accessed through the openings 36 by inserting the fingers from the sidewalls 34A sides of the storage containers 6 corresponding to the openings 36, and thus the medications only in the storage partitions 31 can be taken out.

Additionally, respective openings 36 are openably closed by a plurality of doors 37 attached to the inner door 3, respectively. Each door 37 is independently locked and unlocked by lock solenoids (locking means) 38 which will be described hereinafter, respectively. Meanwhile, 7-segment LEDs (display means) 39 are provided in the front of the inner door 3 at positions corresponding to respective sides of each of the doors 37. This LED 39 displays the number of medications. Note that, reference numeral 41 is a transparent glass attached to the outer door 2 and the doors 37 and the LEDs 39 are arranged to be visible so as to be seen from outside through the transparent glass 41 without opening the outer door 2.

Figure 14:
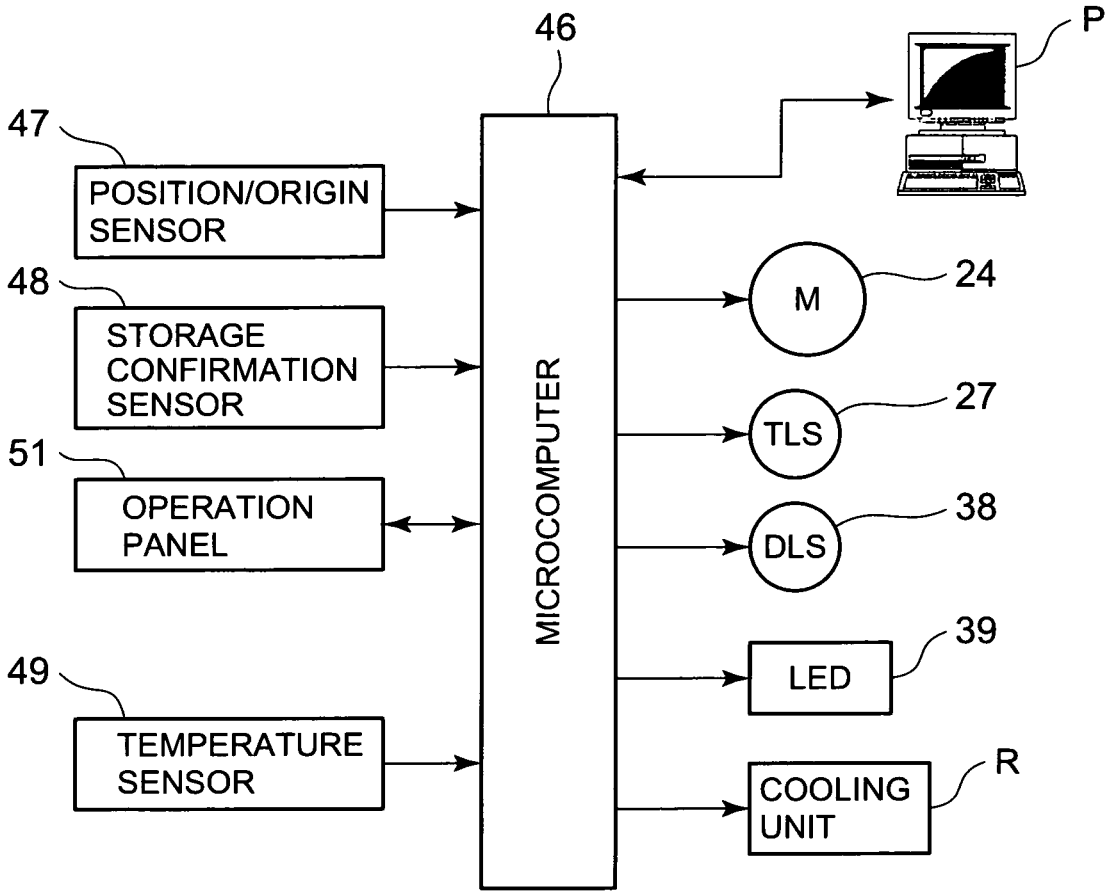
FIG. 14 is a block diagram of an electric circuit of the medication storage in FIG. 1.

Next, reference numeral 46 is a controller (control means) including a microcomputer in FIG. 14, and outputs of position/origin sensors 47 (actually, seven sensors corresponding to the number of shelves 4) for respectively detecting a position (origin) of each shelf 4, outputs of storage confirmation sensors (the same number of storage containers 6) 48 for detecting the storage containers 6 attached on each shelf 4, and an output of a temperature sensor 49 for detecting a temperature in the storeroom 10 are connected to the controller 46. Additionally, an operation panel 51 arranged in the upper portion of the front face of the body 11 is also connected to the control means 46.

Further, the motors 24 (actually seven), the solenoids 27 (actually seven), the lock solenoids 38 (actually seven which is moved to a locking position upon being electrically turned off, and to an unlocking position upon being electrically turned on), the LEDs 39 (actually seven), and the cooling unit R are connected to an output of the controller 46. Moreover, the controller 46 transmits and receives data to and from an external personal computer P.

Operation of the medication storage 1 will be described below based on the above configuration. Note herein that, medications (blood (bags) or drugs with a predetermine number, which need to be refrigerated (filled in containers), are stored in each storage partition 31 in each storage container 6 on each shelf 4, by the predetermined number, respectively. Types (names) and the number of medications stored in each storage partition 31 in each storage container 6 on each shelf 4, and a database on the positions of the storage containers 6 in which they are stored are then set to the controller 46 and the personal computer P. In this case, the controller 46 detects and comprehends the storage containers 6 attached on all the shelves 4 by the storage confirmation sensors 48.

Additionally, the controller 46 controls operations of the compressor 12 and the fan in the cooling unit R based on the output of the temperature sensor 49, and the cold air is circulated in the storeroom 10 to thereby maintain a temperature inside the storeroom 10 at an optimal temperature of +4° C.±1 deg for the medications as described above. This makes it possible to refrigerate and store the medications in each storage partition 31 at the optimal temperature. Meanwhile, it is to be generally noted that the outer door 2 should be unlocked and the inner door 3 should be locked. Incidentally, such an alternative manner may be taken that the outer door 2 is normally locked, and is unlocked when the door 37 is unlocked, as described hereinafter.

For example, when a doctor inputs prescription data into the personal computer P, the prescription data is transmitted to the controller 46 in the medication storage 1. Incidentally, the medications selected based on the prescription data and the number thereof will be subtracted from the database of the personal computer P.

Meanwhile, when the controller 46 receives the prescription data from the personal computer P, the solenoid 27 corresponding to the shelf 4 having thereon the storage container 6 (storage partition 31) in which medications selected based on the prescription data are stored is turned on and the engagement with the pin 28 is released, and the motor 24 corresponding to the shelf 4 is also electrically turned on to drive the motor per se, and the shelf 4 is then rotated to bring the storage container 6 (storage partition 31) to a position corresponding to the backside of the opening 36 in the center of the front face. At this time, the controller 46 comprehends a rotating angle of the shelf 4 by the position/origin sensor 47 and then controls the rotation of the shelf 4. Meanwhile, the motor 24 can rotate back and forth, and the controller 46 rotates the shelf 4 (motor 24) in a direction whose rotation angle from the present position (position of the storage container 6) to the center of the front face is smaller. When the storage container 6 (storage partition 31) reaches the center of the front face, the controller 46 then turns off the motor 24, and also turns off the solenoid 27 to be engaged with the pin 28, so that the rotation is stopped. As a result of this, the shelf 4 cannot be rotated freely.

Thereafter, the controller 46 basically electrically turns off the motor 24 and the solenoid 27 during the standby state. As a result of this, disadvantages that heat generated when they are turned on has an adverse effect on cool-down inside the storeroom 10 is suppressed When the storage containers 6 (storage partitions 31) in which all the medications selected based on the prescription data are stored are located in different shelves 4, the controller 46 simultaneously rotates each shelf 4 to make the storage containers 6 (storage partitions 31) in which each medication is stored correspond to the backside of the opening 36 in the center of the front face. Incidentally, when the selected medications are present in different storage containers 6 (storage partition 31) on the same shelf 4, operations in which after a first medication is taken out (after locking the door 37), the solenoid 27 corresponding to the shelf 4 is turned on again to release the engagement with the pin 28, the motor 24 corresponding to the shelf 4 is turned on to rotate the shelf 4, the storage container 6 (storage partition 31) for the other remaining medication is brought to a position corresponding to the center of the front face, and the lock solenoid 38 of the door 37 is unlocked will be repeated as described hereinafter.

After the controller 46 makes the storage containers 6 (storage partitions 31) on one or more shelves 4 in which the medications based on the prescription data are stored correspond to the front center, the lock solenoid 38 of the door 37 of the opening 36 to which the storage container 6 (storage containers 6) correspond(s) is turned on to unlock it. Meanwhile, the number of medications selected based on the prescription data (number of medications to be taken out) is displayed and indicated by the LED 39 corresponding to the door 37 (when taking out the medications from a plurality of shelves 4, the numbers of medications to be taken out of the storage partitions 31 on the shelves 4 are displayed on the LEDs 39 of the doors 37 of the openings 36 corresponding to each shelf 4, respectively).

Next, a worker or a handler (for example, a nurse) releases the outer door 2 and then opens the door 37 on which the LED 39 is lighting (the number is displayed). Only medications whose number is displayed thereon are then taken out of the storage partitions 31 corresponding to the backsides, and the doors 37 are closed. After the doors 37 are closed, the controller 46 turns off the lock solenoids 38 and locks the doors 37. Once all the medications on the shelves 4 or all the medications in the prescription data are completely taken out, the outer door 2 is closed again and the work is finished.

Since the medications are stored in the medication storage 1 while they are cooled down as described above, degradation of drug efficacy can be prevented. Additionally, when taking out a prescribed medication from the inside of the storeroom 10, the controller 46 automatically rotates the shelves 4 based on the prescription data and makes the storage partition 31 in which the medications are stored correspond to the opening 36, and then unlocks the lock solenoid 38 of the door 37 of the opening 36, thus allowing the worker to take out the prescribed medications through the opening 36 whose door 37 is unlocked.

At this time, since the medication only in the storage partition 31 can be taken out through the opening 36 and the solenoids 27 are engaged with the pins 28 to thereby prevent the rotation of the shelves 4, the disadvantage that the medications other than the prescribed medication may be taken out of the storeroom can be certainly prevented. Hence, so-called accidental ingestion or any theft can be prevented from occurring with certainty. In this case, since only the opening 36 of the shelf 4 in which the medications are stored may be opened upon taking out the medications, cold air leakage from the storeroom 10 can also be reduced to the minimum level. This makes it possible to highly maintain cooling performance in the storeroom as well.

Moreover, since the LED 39 is provided at the inner door 3 and the controller 46 displays and indicates the number of medications to be taken out by the LED 39 based on the prescription data, when a nurse or the like except for a doctor takes out the medications, the disadvantages that the medications with an incorrect number are taken out can be prevented from occurring. In this case, since a plurality of LEDs 39 are provided corresponding to each door 37, respectively, respective medications can be taken out without mistaking the number even when the medications are taken out from a plurality of shelves 4. Additionally, since a plurality of motors 24 are provided corresponding to shelves 4, respectively, a plurality of shelves 4 can be independently rotated simultaneously, resulting in a significant increase in working efficiency.

Note that, when the medications in the storage partitions 31 run out or become less by taking out the medications like this, medications must be replenished. Since the storage containers 6 can be taken out through the openings 36 even in such a case, the replenishing work can be performed in a state where the storage containers 6 are taken out through the openings 36, resulting in a significant improvement in workability.

Meanwhile, the controller 46 turns on the solenoid 27 of each shelf 4 at a certain time interval, and also turns on the motor 24 to rotate the shelf 4, for example, by half (180 degrees) in the standby state. As a result of this, since a position of the storage partition 31 in the storeroom 10 is changed, the medications in each storage partition 31 on each shelf 4 can be uniformly cooled, thus enabling a significant improvement in preserving performance.

Note that, although a plurality of storage partitions 31 are constituted in a plurality of storage containers 6 attached on the shelf 4 in the embodiment, it is not limited to this in the invention according to claim 1, but a plurality of storage partitions may be constituted by partitioning the shelf 4 with the partitioning walls.

What is claimed is:

1. A medication storage configured to cool down inside of a storeroom for storing medications to a predetermined temperature by a cooling unit, comprising:

a plurality of shelves rotatably provided in the storeroom;

a plurality of storage partitions provided for each of the respective shelves to store the medications, respectively;

a driving means for each shelf for rotating each shelf independently in either direction;

a plurality of openings provided respectively to correspond to each of the respective shelves for allowing only medication in any one of the storage partitions to be taken out therethrough;

a plurality of doors for openably closing each of the openings, respectively;

a plurality of locking means for locking each door, respectively; and a control means for controlling the driving means and the locking means, wherein the control means is configured to permit the drive means to rotate the shelves based on prescription data thereby allowing a predetermined storage partition to correspond to one of the openings and then to permit the locking means of the door which closes the opening to be unlocked, the control means is configured to control the drive means to independently rotate a plurality of shelves simultaneously and to rotate at least one shelf in one rotational direction at the same time as rotating at least one other shelf in the opposite rotational direction, and a plurality of storage containers are provided to be removably attached to each of the shelves, respectively, each of the storage containers defining therein each of the storage partitions and being capable of being taken out through the opening, wherein each of the plurality of storage containers is provided on a bottom portion thereof with an engaging part for removably engaging with one of a plurality of engaging parts on said plurality of shelves, wherein the locking means are moved to a locking position upon being electrically turned off, and the control means permits the locking means to be unlocked by electrically turning on the locking means, and wherein the opening is enough to allow only one storage container to be taken out, and the storage container is provided with sidewalls set up in the circumference.

2. The medication storage according to claim 1, further comprising a display means, and wherein the control means permits the display means to display a number of medications to be taken out based on prescription data.

3. The medication storage according to claim 2, wherein a plurality of the display means are provided for being, arranged to correspond to each of the doors, respectively.

4. The medication storage according to claim 1, wherein a plurality of the driving means are provided for being arranged to correspond to each of the shelves, respectively.

5. The medication storage according to claim 1, wherein the driving means is provided in the storeroom, a rotation preventing means is provided in the storeroom which is configured to allow the shelves rotating upon being electrically turned on while prohibiting the shelves rotating upon being electrically turned off, and the control means electrically turns off the driving means and the rotation preventing means in a state where the shelves are to be not rotated.

6. The medication storage according to claim 1, wherein the control means permits the drive means to rotate the shelves in a standby mode.

7. The medication storage according to claim 1, wherein the shelves are disc-shaped;

the storage container is almost fan-shaped when looked at from a plan view;

the storage containers are arranged on the shelf almost without gaps therebetween while setting a pivot of the fan as a center direction the shelf;

a triangular engaging projecting part is formed in the bottom faces the respective storage container; and the engaging projecting part is removably engaged in a triangular engaging hole formed in the shelf.

* * * * *